US010202742B2

(12) United States Patent
Morimoto

(10) Patent No.: US 10,202,742 B2
(45) Date of Patent: Feb. 12, 2019

(54) EXCAVATOR

(71) Applicant: SUMITOMO(S.H.I.) CONSTRUCTION MACHINERY CO., LTD., Tokyo (JP)

(72) Inventor: Takaaki Morimoto, Chiba (JP)

(73) Assignee: SUMITOMO(S.H.I.) CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 15/705,410

(22) Filed: Sep. 15, 2017

(65) Prior Publication Data

US 2018/0002900 A1 Jan. 4, 2018

Related U.S. Application Data

(63) Continuation of application No. PCT/JP2016/058520, filed on Mar. 17, 2016.

(30) Foreign Application Priority Data

Mar. 19, 2015 (JP) ..... 2015-056871

(51) Int. Cl.

| | |
|---|---|
| ***B60Q 1/00*** | (2006.01) |
| ***E02F 9/26*** | (2006.01) |
| *E02F 3/32* | (2006.01) |

(52) U.S. Cl.

CPC ..... *E02F 9/261* (2013.01); *E02F 9/264* (2013.01); *E02F 3/32* (2013.01)

(58) Field of Classification Search

CPC ..... E02F 9/261; E02F 3/32
USPC ..... 340/435
See application file for complete search history.

(56) References Cited

U.S. PATENT DOCUMENTS

| | | | | |
|---|---|---|---|---|
| 2013/0158787 | A1 | 6/2013 | Nomura et al. | |
| 2014/0100712 | A1* | 4/2014 | Nomura | E02F 3/32 701/1 |
| 2016/0024757 | A1 | 1/2016 | Nomura et al. | |

FOREIGN PATENT DOCUMENTS

| | | |
|---|---|---|
| JP | 2012-172425 | 9/2012 |
| JP | 2012-172431 | 9/2012 |
| JP | 2014-148893 | 8/2014 |
| JP | 2014-205955 | 10/2014 |

OTHER PUBLICATIONS

International Search Report for PCT/JP2016/058520 dated May 17, 2016.

* cited by examiner

*Primary Examiner* — Tanmay Shah
(74) *Attorney, Agent, or Firm* — IPUSA, PLLC

(57) ABSTRACT

An excavator includes a machine guidance device having a machine guidance function, wherein the machine guidance function performs voice sound guidance by emitting a report sound when a region of work by an end attachment approaches a predetermined distance to an excavation target surface, and performs the voice sound guidance by emitting a report sound when the region of work by the end attachment approaches a predetermined distance to an extension surface, also in an area along the extension surface set in an extended direction from the excavation target surface.

7 Claims, 5 Drawing Sheets

EXCAVATOR

CROSS-REFERENCE TO RELATED APPLICATION

The present application is a continuation application of International Application No. PCT/JP2016/058520 filed on Mar. 17, 2016, which claims priority to Japanese Priority Patent Application No. 2015-056871, filed on Mar. 19, 2015. The contents of these applications are incorporated herein by reference in their entirety.

BACKGROUND OF THE INVENTION

1. Field of the Invention

The present invention relates to an excavator including a machine guidance function.

2. Description of the Related Art

Skilled operation techniques are required of operators of construction machines such as excavators, in order to efficiently and accurately perform work such as excavation by attachments. Therefore, there is an excavator provided with a function (referred to as machine guidance) for guiding the operation of the excavator, so that even an operator with little operation experience of the excavator can perform the work efficiently and accurately.

For example, as machine guidance of an excavator, there is known a display system that displays, as images, a cross section of a part where excavation work is performed and an excavation tool on a display device, to visually guide the work (for example, refer to Patent Literature 1). In this display system, for example, an excavation target line is displayed on the cross section of the part to be excavated, and a position of a bucket with respect to the excavation target line is also displayed together with the excavation target line. For example, the operator can confirm whether the toe of the bucket is moving along the excavation target line, in the display device.

In the display system described above, for the portion where the inclination of the excavation surface changes in the cross section (for example, the portion where the inclined surface changes to a horizontal surface), an extension line extended from the excavation target line is merely displayed, for example, by a dotted line. That is, for example, even when there is a portion where the inclination of the target excavation surface changes on the cross section, guidance is given by displaying only one excavation target line and the extension line of the excavation target line is displayed, and guidance such as notifying of the portion where the inclination changes, is not performed.

SUMMARY OF THE INVENTION

An aspect of the present invention provides an excavator, in which one or more of the above-described disadvantages are reduced.

According to one aspect of the present invention, there is provided an excavator an excavator including a machine guidance device having a machine guidance function. The machine guidance function performs voice sound guidance by emitting a report sound when a region of work by an end attachment approaches a predetermined distance to an excavation target surface, and performs the voice sound guidance by emitting a report sound when the region of work by the end attachment approaches a predetermined distance to an extension surface, also in an area along the extension surface set in an extended direction from the excavation target surface.

DETAILED DESCRIPTION OF THE PREFERRED EMBODIMENTS

A problem to be solved by an embodiment of the present invention is to provide an excavator capable of giving guidance for appropriate operations even for a portion where the excavation target line is bent in the cross section.

An embodiment of the present invention will be described with reference to drawings.

Figure 1:
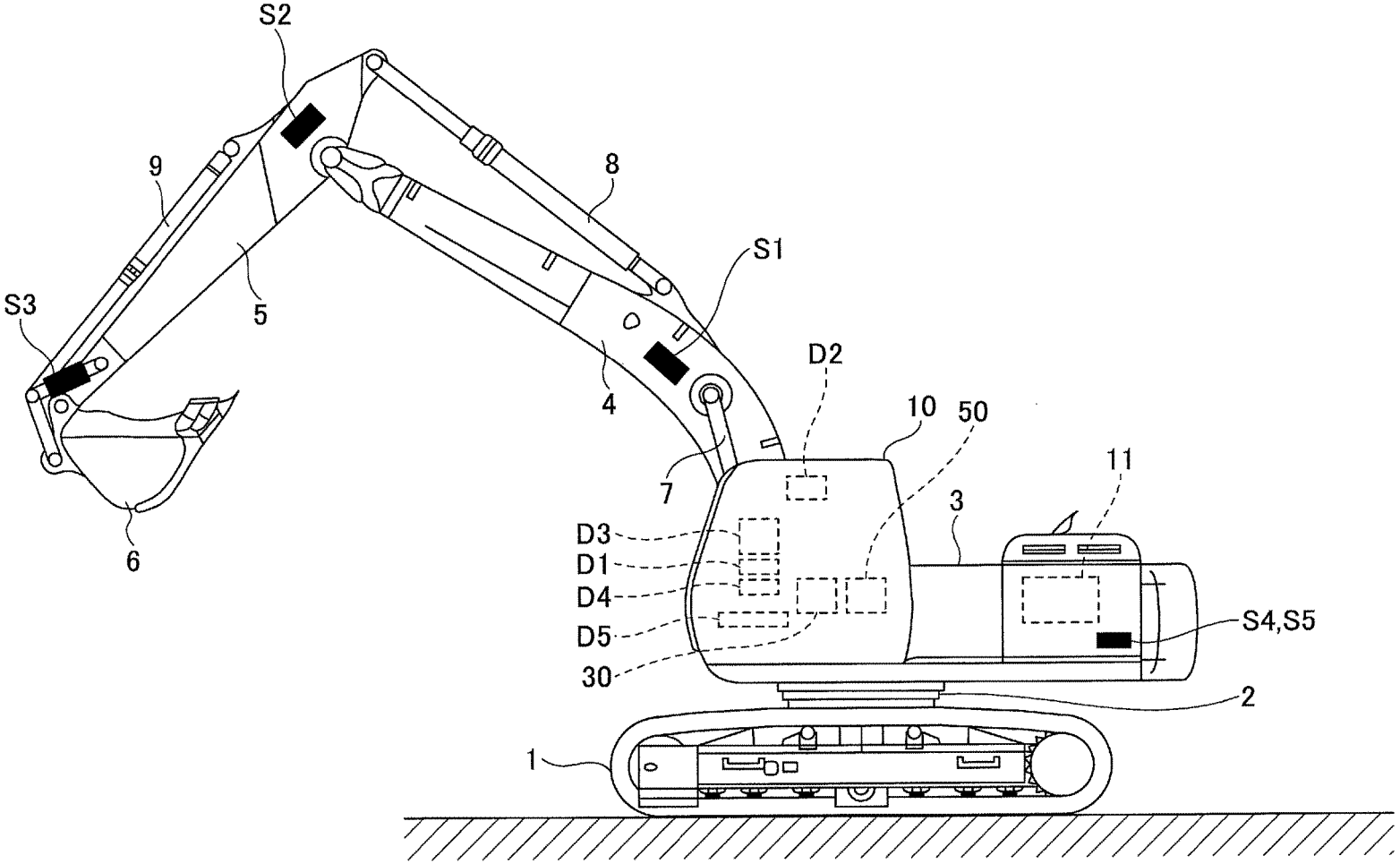
FIG. 1 is a side view of an excavator according to an embodiment of the present invention.

FIG. 1 is a side view of an excavator according to an embodiment. An upper turning body 3 is mounted on a lower travelling body 1 of the excavator, via a turning mechanism 2. A boom 4 is attached to the upper turning body 3. An arm 5 is attached to a front end of the boom 4, and a bucket 6 as an end attachment is attached to the tip of the arm 5. As an end attachment, a slope work bucket or a dredging bucket, etc., may be used.

The boom 4, the arm 5, and the bucket 6 constitute an excavator attachment as an example of an attachment, and are hydraulically driven by a boom cylinder 7, an arm cylinder 8, and a bucket cylinder 9, respectively. A boom angle sensor S1 is attached to the boom 4, an arm angle sensor S2 is attached to the arm 5, and a bucket angle sensor S3 is attached to the bucket 6. A bucket tilt mechanism may be provided in the excavator attachment. The boom angle sensor S1, the arm angle sensor S2, and the bucket angle sensor S3 may be referred to as "attitude sensors" in some cases.

The boom angle sensor S1 detects the rotation angle of the boom 4. In the present embodiment, the boom angle sensor S1 is an acceleration sensor that detects the inclination with respect to the horizontal surface and detects the rotation angle of the boom 4 with respect to the upper turning body 3. The arm angle sensor S2 detects the rotation angle of the arm 5. In the present embodiment, the arm angle sensor S2 is an acceleration sensor that detects the inclination with respect to the horizontal surface and detects the rotation angle of the arm 5 with respect to the boom 4. The bucket angle sensor S3 detects the rotation angle of the bucket 6. In the present embodiment, the bucket angle sensor S3 is an acceleration sensor that detects the inclination with respect to the horizontal surface and detects the rotation angle of the bucket 6 with respect to the arm 5. When the excavator attachment includes a bucket tilt mechanism, the bucket angle sensor S3 additionally detects the rotation angle of the bucket 6 around the tilt axis. The boom angle sensor S1, the arm angle sensor S2, and the bucket angle sensor S3 may be a potentiometer using a variable resistor, a stroke sensor that detects the stroke amount of a corresponding hydraulic cylinder, or a rotary encoder that detects the rotation angle around a connecting pin, etc.

A cabin 10 is provided on the upper turning body 3, and a power source such as an engine 11 is mounted on the upper turning body 3. Furthermore, a body inclination sensor S4 is attached to the upper turning body 3. The body inclination sensor S4 is a sensor that detects the inclination of the upper turning body 3 with respect to the horizontal surface. The body inclination sensor S4 may also be referred to as an "attitude sensor".

In the cabin 10, an input device D1, a voice sound output device D2, a display device D3, a storage device D4, a gate lock lever D5, a controller 30, and a machine guidance device 50 are installed.

The controller 30 functions as a main control unit that performs drive control of the excavator. In the present embodiment, the controller 30 is constituted by an arithmetic processing unit including a CPU and an internal memory. Various functions of the controller 30 are implemented by the CPU executing programs stored in the internal memory.

The machine guidance device 50 includes a guidance function for guiding the operation of the excavator. In the present embodiment, for example, the machine guidance device 50 visually and audibly reports, to the operator, the distance in the vertical direction between the surface of the target landform set by the operator and the tip (toe) position of the bucket 6. Accordingly, the machine guidance device 50 guides the operation of the excavator by the operator. Note that the machine guidance device 50 may only visually report the distance to the operator, or may only audibly report the distance to the operator. Specifically, similar to the controller 30, the machine guidance device 50 is constituted by an arithmetic processing unit including a CPU and an internal memory. Various functions of the machine guidance device 50 are implemented by the CPU executing programs stored in the internal memory. The machine guidance device 50 may be provided separately from the controller 30, or may be incorporated in the controller 30.

The input device D1 is a device for the operator of the excavator to input various kinds of information to the machine guidance device 50. In the present embodiment, the input device D1 is a membrane switch attached to the surface of the display device D3. A touch panel, etc., may be used as the input device D1.

The voice sound output device D2 outputs various kinds of voice sound information in response to a voice sound output command from the machine guidance device 50. In the present embodiment, an in-vehicle speaker, which is directly connected to the machine guidance device 50, is used as the voice sound output device D2. Note that a reporting device such as a buzzer may be used as the voice sound output device D2.

The display device D3 outputs various kinds of image information in response to a command from the machine guidance device 50. In the present embodiment, an in-vehicle liquid crystal display, which is directly connected to the machine guidance device 50, is used as the display device D3.

The storage device D4 is a device for storing various kinds of information. In the present embodiment, a non-volatile storage medium such as a semiconductor memory is used as the storage device D4. The storage device D4 stores various kinds of information output by the machine guidance device 50, etc.

The gate lock lever D5 is a mechanism for preventing the excavator from being erroneously operated. In the present embodiment, the gate lock lever D5 is disposed between the door of the cabin 10 and the driver's seat. When the gate lock lever D5 is pulled up such that the operator cannot exit the cabin 10, various operation devices become operable. On the other hand, when the gate lock lever D5 is depressed such that the operator can exit the cabin 10, various operation devices become inoperable.

Figure 2:
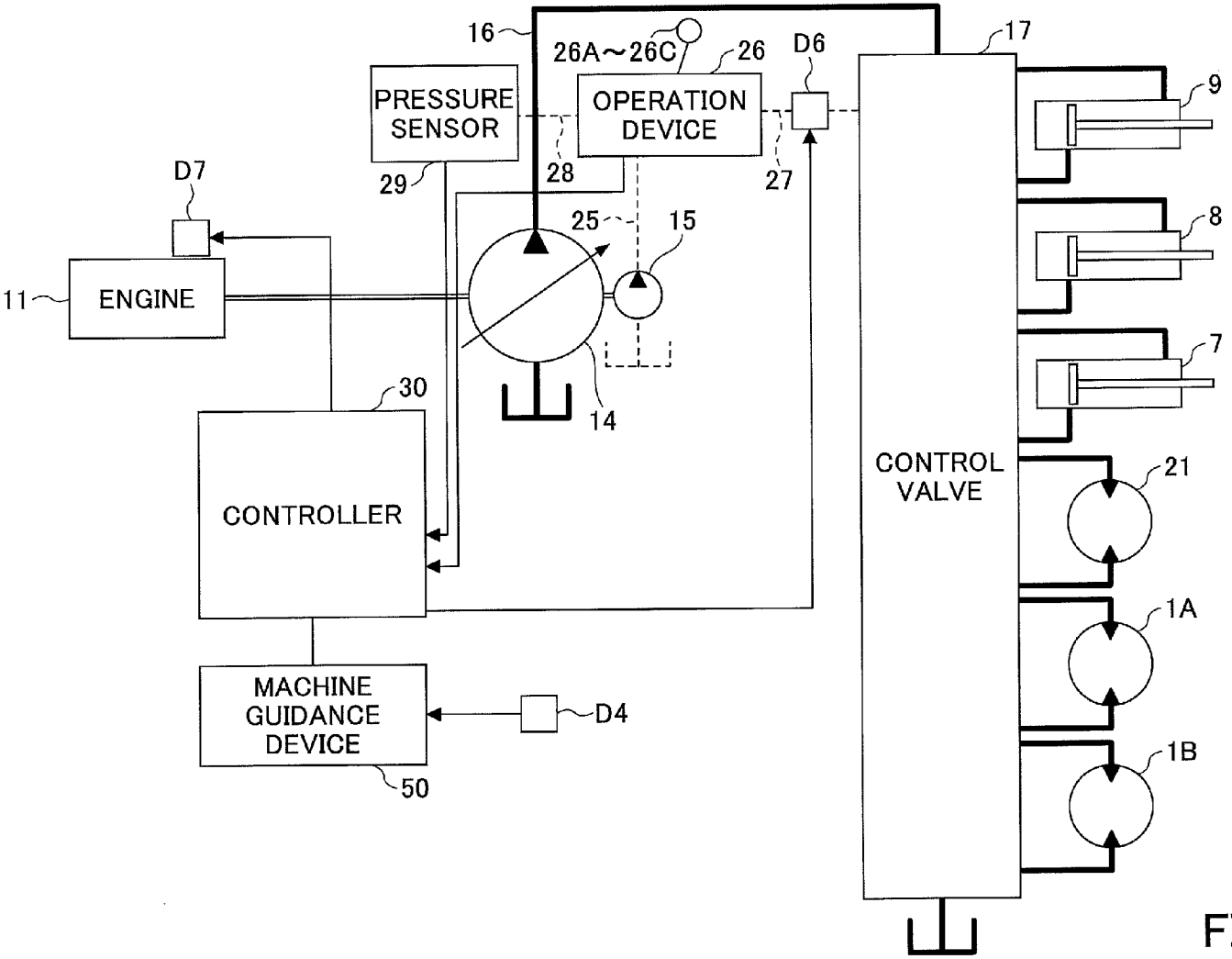
FIG. 2 is a block diagram showing a configuration of a driving system of the excavator of FIG. 1.

FIG. 2 is a block diagram showing a configuration of a driving system of the excavator of FIG. 1. In FIG. 2, a mechanical power system is indicated by double lines, high-pressure hydraulic lines are indicated by thick solid lines, pilot lines are indicated by dashed lines, and electric drive and control systems are indicated by thin solid lines.

The engine 11 is a power source of the excavator. In the present embodiment, the engine 11 is a diesel engine that employs isochronous control for maintaining a constant engine rotational speed regardless of an increase or a decrease in the engine load. The fuel injection amount, the fuel injection timing, and the boost pressure, etc., in the engine 11 are controlled by an engine controller D7.

The engine controller D7 is a device for controlling the engine 11. In the present embodiment, the engine controller D7 executes various functions such as an automatic idle function and an automatic idle stop function.

The automatic idle function is a function of reducing the engine rotational speed from a regular rotational speed (for example, 2000 rpm) to an idle rotational speed (for example, 800 rpm), when a predetermined, condition is satisfied. In the present embodiment, the engine controller D7 operates the automatic idle function according to an automatic idle command from the controller 30 to reduce the engine rotational speed to the idle rotational speed.

The automatic idle stop function is a function of stopping the engine 11 when a predetermined condition is satisfied. In the present embodiment, the engine controller D7 operates the automatic idle stop function in response to an automatic idle stop command from the controller 30 to stop the engine 11.

A main pump 14 and a pilot pump 15 as hydraulic pumps, are connected to the engine 11. A control valve 17 is connected to the main pump 14 via a high pressure hydraulic line 16.

The control valve 17 is a hydraulic control device that controls the hydraulic system of the excavator. Hydraulic actuators such as a right side traveling hydraulic motor 1A, a left side traveling hydraulic motor 1B, the boom cylinder 7, the arm cylinder 8, the bucket cylinder 9, and a turning hydraulic motor 21, etc., are connected to the control valve 17 via a high pressure hydraulic line.

An operation device 26 is connected to the pilot pump 15 via a pilot line 25.

The operation device 26 includes a lever 26A, a lever 26B, and a pedal 26C. In the present embodiment, the operation device 26 is connected to the control valve 17 via a hydraulic line 27 and a gate lock valve D6. Furthermore, the operation device 26 is connected to a pressure sensor 29 via a hydraulic line 28.

The gate lock valve D6 switches the communication/shutoff of the hydraulic line 27 connecting the control valve 17 and the operation device 26. In the present embodiment, the gate lock valve D6 is a solenoid valve that switches communication/shutoff of the hydraulic line 27 according to a command from the controller 30. The controller 30 determines the state of the gate lock lever D5 based on a state signal output from the gate lock lever D5. Then, when the controller 30 determines that the gate lock lever D5 is in a pulled up state, the controller 30 outputs a communication command to the gate lock valve D6. Upon receiving the communication command, the gate lock valve D6 opens to bring the hydraulic line 27 into communication. As a result, the operator's operation on the operation device 26 becomes effective. On the other hand, when the controller 30 determines that the gate lock lever D5 is in a pulled down state, the controller 30 outputs a shutoff command to the gate lock valve D6. Upon receiving the shutoff command, the gate lock valve D6 is closed to shut off the hydraulic line 27. As a result, the operator's operation on the operation device 26 becomes invalid.

The pressure sensor 29 detects the operation content of the operation device 26, in the form of pressure. The pressure sensor 29 outputs a detection value to the controller 30.

Figure 3:
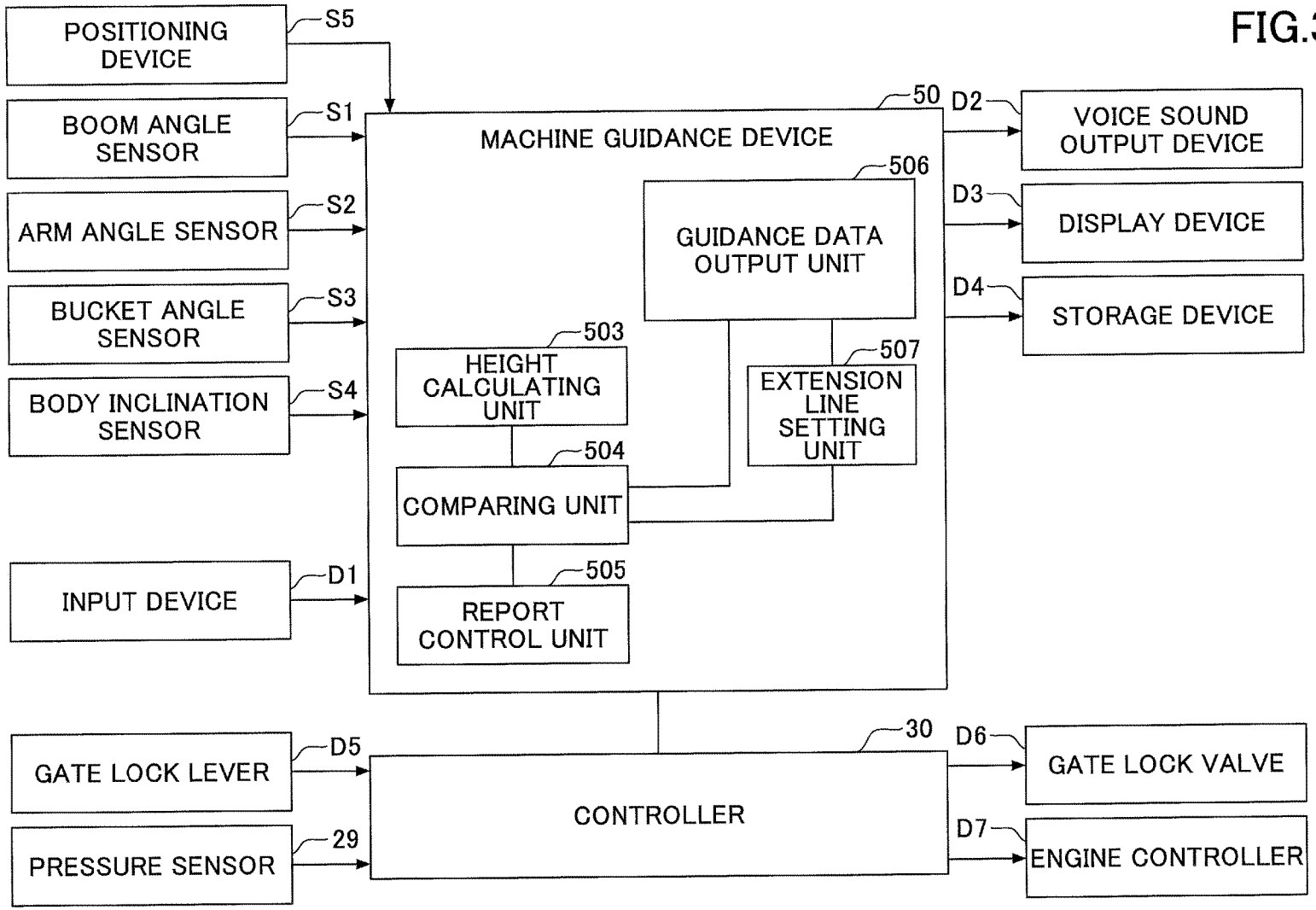
FIG. 3 is a block diagram showing the functional configurations of a controller and a machine guidance device.

Next, various functional elements provided in the controller 30 and the machine guidance device 50 will be described with reference to FIG. 3. FIG. 3 is a functional block diagram showing configurations of the controller 30 and the machine guidance device 50.

In the present embodiment, the controller 30 controls whether to perform guidance by the machine guidance device 50, in addition to controlling the operation of the entire excavator. Specifically, the controller 30 determines whether the excavator is at rest, based on the state of the gate lock lever D5 and the detection signal from the pressure sensor 29, etc. Then, when the controller 30 determines that the excavator is at rest, the controller 30 transmits a guidance stop command to the machine guidance device 50 so as to stop the guidance by the machine guidance device 50.

Furthermore, the controller 30 may output a guidance stop command to the machine guidance device 50, when outputting an automatic idle stop command to the engine controller D7. Alternatively, the controller 30 may output a guidance stop command to the machine guidance device 50 when the controller 30 determines that the gate lock lever D5 is in a pressed down state.

Next, the machine guidance device 50 will be described. In the present embodiment, the machine guidance device 50 receives various signals and data output from the boom angle sensor S1, the arm angle sensor S2, the bucket angle sensor S3, the body inclination sensor S4, the input device D1, and the controller 30. The machine guidance device 50 calculates an actual operation position of the attachment (for example, the bucket 6) based on the received signal and data. Then, when the actual operation position of the attachment is different from the target operation position, the machine guidance device 50 transmits a report command to the voice sound output device D2 and the display device D3 to issue a report. The machine guidance device 50 and the controller 30 are connected so as to communicate with each other through a CAN (Controller Area Network).

The machine guidance device 50 includes functional units that perform various functions. In the present embodiment, the machine guidance device 50 includes a height calculating unit 503, a comparing unit 504, a report control unit 505, a guidance data output unit 506, and an extension line setting unit 507, as functional units for guiding the operation of the attachment.

The height calculating unit 503 calculates the height of the tip (toe) of the bucket 6 from the angles of the boom 4, the arm 5, and the bucket 6 calculated from the detection signals of the sensors S1 to S4. Here, since the excavation is performed by the tip of the bucket 6, the tip (toe) of the bucket 6 corresponds to the work region of the end attachment. For example, when performing work of trimming earth and sand with the back surface of the bucket 6, the back surface of the bucket 6 corresponds to the work region of the end attachment. Furthermore, when a breaker is used as an end attachment other than the bucket 6, the tip of the breaker corresponds to the work region of the end attachment.

A positioning device S5 is a device for measuring the position and orientation of the excavator. In the present embodiment, the positioning device S5 is a GNSS receiver in which an electronic compass is incorporated, and the positioning device S5 measures the latitude, the longitude, and the altitude of the position where the excavator is present, and measures the orientation of the excavator. Thus, the latitude, the longitude, and the altitude of the height of the tip (toe) of the bucket 6 can also be measured.

The comparing unit 504 compares the height of the tip (toe) of the bucket 6 calculated by the height calculating unit 503 with the target height of the tip (toe) of the bucket 6 indicated by the guidance data output from the guidance data output unit 506. In the case of using GNSS, the comparing unit 504 calculates respective coordinates relating to the latitude, the longitude, and the altitude of the calculated tip height of the bucket 6, and compares the height of the tip of the bucket 6 and the coordinates of the excavation target lines TL1 and TL2.

The report control unit 505 transmits a report command to both or one of the voice sound output device D2 and the display device D3 when it is determined that reporting is necessary based on the comparison result by the comparing unit 504. Upon receiving the report command, the voice sound output device D2 and the display device D3 issue a predetermined report to send a notification to the operator of the excavator.

As described above, the guidance data output unit 506 extracts the target height data of the bucket 6 from the guidance data stored in advance in the storage device of the machine guidance device 50, and outputs the target height data to the comparing unit 504. At this time, the excavation target lines TL1 and TL2 are set as the topography data of the target landform surface corresponding to the respective coordinates relating to the latitude, the longitude, and the altitude of the construction surface, and are output from the guidance data output unit 506. Furthermore, the guidance data output unit 506 outputs data on the target height of the bucket corresponding to the inclination angle of the excavator detected by the body inclination sensor S4.

The extension line setting unit 507 sets an extension line of the target excavation line in the data output from the guidance data output unit 506, and outputs data including the extension line to the comparing unit 504. The coordinates of the extension line are also set based on the excavation target lines TL1 and TL2. The function of the extension line setting unit 507 will be described later.

Figure 4:
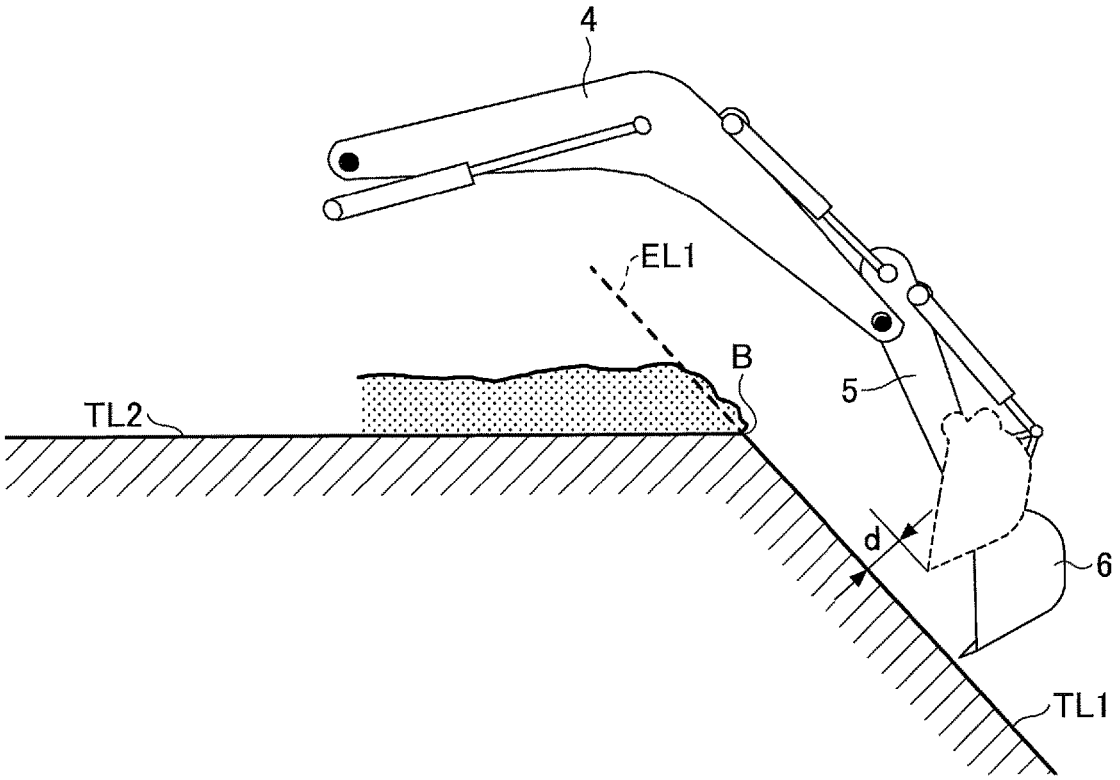
FIG. 4 is a diagram for describing an example of a guidance process when guiding the work by a bucket.

Next, an example of a guidance process by the machine guidance device 50 will be described with reference to FIG. 4. FIG. 4 is a diagram for describing an example of a guidance process when guiding the work by the bucket 6. The example of the guidance process shown in FIG. 4 is a guidance process when the excavation target surface is bent. The bent excavation target surface is a target surface in excavation work in which the excavation surface shifts from an inclined surface to a horizontal surface, for example. On the display screen of the machine guidance device 50, for example, as shown in FIG. 4, the bent excavation target surface means that an excavation target line TL1 corresponding to an inclined surface and an excavation target line TL2 corresponding to a horizontal surface intersect each other to form a bent excavation target surface. That is, in FIG. 4, the excavation target line TL1 indicates the inclined excavation target surface, and the excavation target line TL 2 indicates the horizontal excavation target surface. The portion where the excavation target line TL1 and the excavation target line TL2 intersect is referred to as a bending point B. The bending point B is not actually a point, but a line of intersection of a portion where the inclined surface indicated by the excavation target line TL1 and the horizontal surface indicated by the excavation target line TL2 intersect each other.

In the guidance process according to the present embodiment, an extension line EL1 indicated by a thick dotted line in the extending direction of the excavation target line TL1, is set. The extension line EL1 corresponds to a portion where the excavation target line TL1 extends beyond the bending point B. The extension line EL1 is set by the extension line setting unit 507 in the guidance data output from the guidance data output unit 506 shown in FIG. 3. Note that the extension line EL1 may be included in advance in the guidance data of the guidance data output unit 506. Note that the extension line EL1 indicates an extension surface extended from the inclined surface indicated by the excavation target line TL1 as described above.

In the guidance process according to the present embodiment, when an angle formed by a plurality of excavation target surfaces exceeds 180° C., as shown in FIG. 4, guidance is executed based on the extension surface (bending point warning area). Note that the extension surface is also included in the bending point warning area. Furthermore, in some cases, only the inclined surface is the excavation target surface (excavation target line TL1), and the flat surface may not be excavated. Therefore, one of the surfaces forming the bent portion may be "a surface that is not to be excavated".

In the guidance process according to the present embodiment, a display as shown in FIG. 4 is displayed on the screen of the display device (display guidance). In addition to this, according to the present embodiment, when the toe of the bucket 6 is located within a predetermined distance d from the excavation target lines TL1 and TL2, a report sound is emitted to report this to the operator (voice sound guidance). Hereinafter, the report sound at this time is referred to as an "in-target report sound". The in-target report sound is emitted continuously or intermittently when the toe of the bucket 6 is positioned within the predetermined distance d. The report sound may be any sound that the operator can hear, for example, a simple sound such as a buzzer sound or an alarm whistle sound, a synthesized sound created by a computer, and a human voice, etc.

Furthermore, when the distance from the excavation target lines TL 1 and TL 2 to the toe of the bucket 6 exceeds the predetermined distance d, a report sound different from the in-target report sound (hereinafter referred to as an "outside-target report sound") may be emitted. The difference between the in-target report sound and the outside-target report sound only needs to be a difference that is distinguishable. Such differences include, for example, various differences such as a difference in timbre, a difference in pitch, and a difference in intermittent time.

In the guidance process according to the present embodiment, also when the toe of the bucket 6 is moving along the extension line EL1, the same voice sound guidance as when moving along the excavation target line TL1 is performed. However, in this case, the in-target report sound and the outside-target report sound are set as report sounds different from the in-target report sound and the outside-target report sound emitted when moving along the excavation target line TL1 (hereinafter referred to as "extension line in-target report sound" and "extension line outside-target report sound"). The extension line in-target report sound and the extension line outside-target report sound are respectively set as different report sounds from the in-target report sound and the outside-target report sound. Such differences in the report sound include, for example, various differences such as a difference in timbre, a difference in pitch, and a difference in intermittent time.

By performing the voice sound guidance as described above also when moving along the extension line EL1, the operator of the excavator can easily recognize that the position of the toe of the bucket 6 has changed to a position along the extension line EL1, due to the change in the report sound. Accordingly, the operator of the excavator can easily recognize that the toe of the bucket 6 is located at the point where the toe of the bucket 6 has passed the bending point B, without looking at the display screen of the guidance, and can easily recognize that the operation of the bucket 6 is to be changed to the direction along the excavation target line TL2.

Specifically, when the bucket 6 is moved along the excavation target line TL 1 (slope face excavation operation), and the toe of the bucket 6 passes the bending point B, the report sound is changed from the in-target report sound or the outside-target report sound, to the extension line in-target report sound or the extension line outside-target report sound. Therefore, this time, the operator moves the bucket 6 along the excavation target line TL2 (horizontal pulling motion).

Furthermore, in the guidance process according to the present embodiment, when the toe of the bucket 6 is located in the vicinity of the bending point B (for example, the distance from the toe of one bucket 6 to the link portion (inner side)), a report sound indicating this situation may be emitted. The report sound at this time is a different sound from the in-target report sound or the outside-target report sound (hereinafter referred to as a "bending point report sound"). The difference between the bending point report sound and the other report sounds (the in-target report sound, the outside-target report sound, the extension line in-target report sound, and the extension line outside-target report sound) only needs to be a difference that is distinguishable. Such differences include, for example, various differences such as such as a difference in timbre, a difference in pitch, and a difference in intermittent time. By hearing the bending point report sound, the operator of the excavator can easily recognize that the toe of the bucket 6 is positioned at the bending point B, without looking at the display screen of the machine guidance, and can easily recognize that the operation of the bucket 6 is to be changed. Note that the distance corresponding to the vicinity of the bending point B can be set to any distance on the screen.

Specifically, when the bucket 6 is moved along the excavation target line TL 1 (slope face excavation operation) and the toe of the bucket 6 reaches the vicinity of the bending point B, the report sound changes from the in-target report sound or the outside-target report sound to the bending point report sound. Therefore, this time, the operator moves the bucket 6 along the excavation target line TL2 (horizontal pulling motion).

Note that after the toe of the bucket 6 passes the bending point B, the bending point report sound is no longer emitted, and regular voice sound guidance process is performed. That is, when the toe of the bucket 6 moves along the excavation target line TL2 after passing the bending point B, and the toe of the bucket 6 is within the predetermined distance d from the excavation target line TL2, the in-target report sound is emitted to report this to the operator. Furthermore, when the distance from the excavation target line TL2 to the toe of the bucket 6 exceeds the predetermined distance d when moving along the excavation target line TL2, the outside-target report sound is emitted to report this to the operator.

Figure 5:
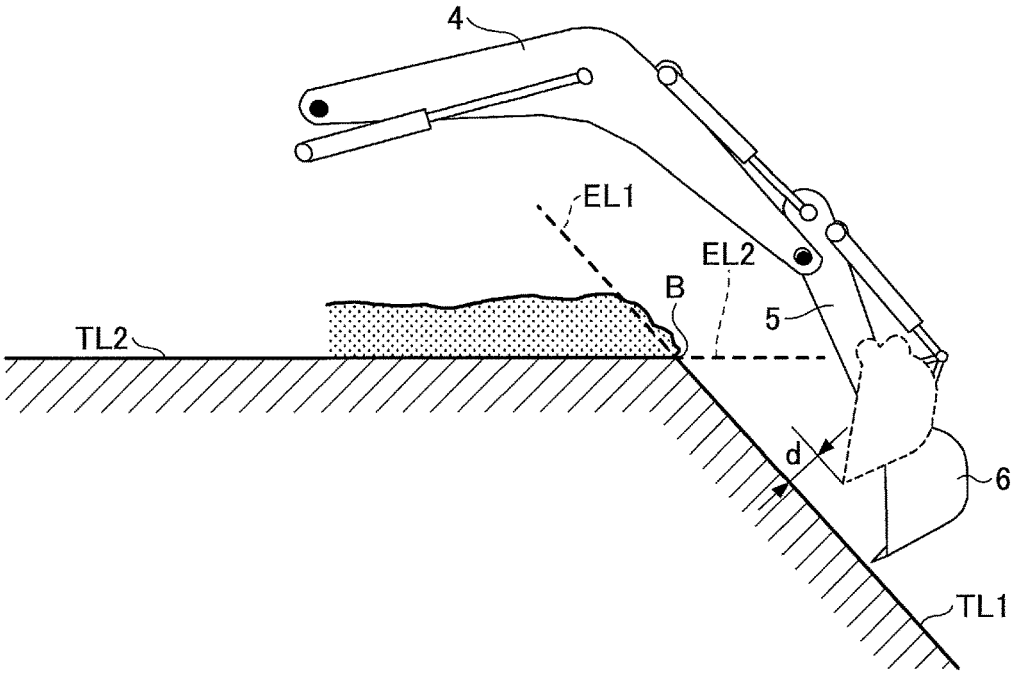
FIG. 5 is a diagram for describing another example of a guidance process when guiding the work by a bucket.

Next, another example of the guidance process according to the present embodiment will be described with reference to FIG. 5. The guidance process described with reference to FIG. 5 is basically the same as the guidance process described with reference to FIG. 4, except that an extension line EL2 is also set on the excavation target line TL2. That is, in the guidance process described with reference to FIG. 5, an extension surface indicated by the extension line EL2 is also set for the horizontal surface indicated by the excavation target line TL2.

In this guidance process, voice sound guidance as described above is also performed in the area along the extension line EL2. That is, also when the toe of the bucket 6 is moving along the extension line EL2, the same voice sound guidance as when moving along the excavation target line TL2 is performed. However, the in-target report sound and the outside-target report sound in this case are set to report sounds different from the in-target report sound and the outside-target report sound that are emitted when moving along the excavation target line TL2 (hereinafter referred to as "extension line in-target report sound" and "extension line outside-target report sound"). The extension line in-target report sound and the extension line outside-target report sound are set as different report sounds from the in-target report sound and the outside-target report sound, respectively. Such differences in the report sound include, for example, various differences such as a difference in timbre, a difference in pitch, and a difference in intermittent time.

Also when the toe of the excavator moves along the extension line EL2, by performing the voice sound guidance as described above, the operator of the excavator can easily recognize that the toe of the bucket 6 has deviated from the excavation target line TL2 and is positioned along the extension line EL2, due to the change in the report sound. Accordingly, the operator of the excavator can easily recognize that the toe of the bucket 6 is located at a point where the toe of the bucket 6 has passed the bending point B, without looking at the display screen of the guidance, and can easily recognize that the operation of the bucket 6 is to be returned to the portion corresponding to the excavation target line TL2.

Note that in the vicinity of the bending point B, the voice sound guidance for the extension line EL1 and the voice sound guidance for the extension line EL2 may be performed at the same time. Therefore, it is desirable to determine in advance whether to prioritize either the voice sound guidance for extension line EL1 or the voice sound guidance for extension line EL2 in consideration of conditions of the excavation work, etc.

Next, yet another example of the guidance process according to the present embodiment will be described with reference to FIG. 6. The guidance process described with reference to FIG. 6 is voice sound guidance for a portion of shifting from a horizontal surface to an inclined surface.

Figure 6:
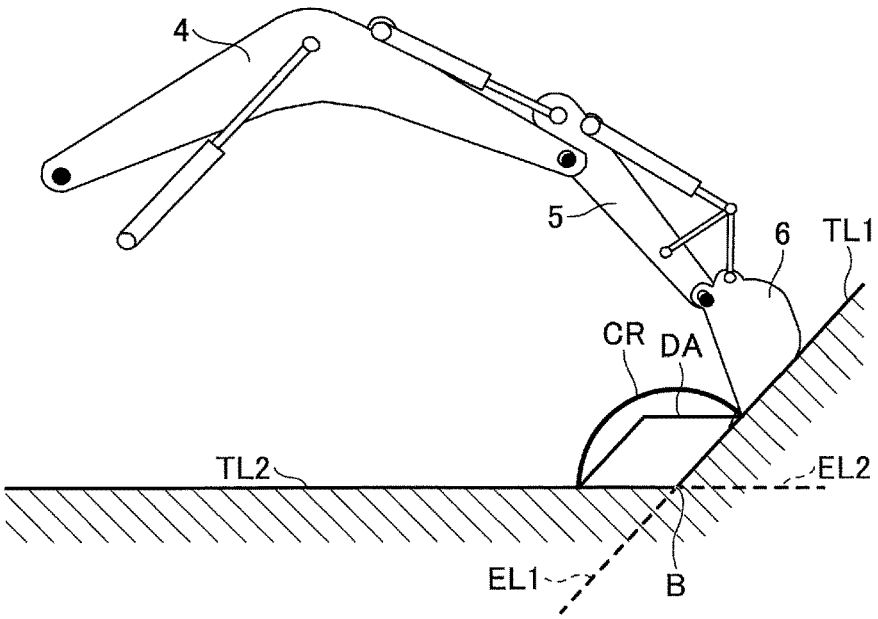
FIG. 6 is a diagram for describing yet another example of a guidance process when guiding the work by a bucket.

In the excavation work by the excavator, as shown in FIG. 6, there may be a shift from excavation of the inclined surface to excavation of the horizontal surface. That is, in the sectional display shown in FIG. 6, the excavation work is performed to operate the bucket 6 along a bent excavation target surface indicated by the excavation target line TL1 and the excavation target line TL2. In this case, the extension line EL1 of the excavation target line TL1 extends into underground, and the portion where the extension line EL1 extends is not a portion to be excavated (that is, a portion to which the toe of the bucket 6 is not to proceed). Likewise, the extension line EL2 of the excavation target line TL2 also extends into underground, and the portion where the extension line EL2 extends is not a portion to be excavated (that is, a portion to which the toe of the bucket 6 is not to proceed).

Note that when the excavation target line TL1 and the excavation target line TL2 are regarded as one bending excavation target line, the bending point B indicates the bending portion of the excavation target surface. On the other hand, when each of the excavation target line TL1 and the excavation target line TL2 is regarded as one excavation target line, the bending point B indicates an intersection point where the excavation target surface indicated by the excavation target line TL1 and the excavation target surface indicated by the excavation target line TL2 intersect.

Therefore, in this guidance process, if it is determined that the extension lines EL1 and EL2 of the excavation target lines TL1 and TL2 extend into underground, the voice sound guidance along the extension lines EL1 and EL2 is not performed. Instead, when the toe of the bucket 6 enters an area in the vicinity of the bending point B where the excavation target line TL1 and the excavation target line TL2 intersect, as described with reference to FIG. 4, the voice sound guidance reporting this situation is performed. Here, in the example shown in FIG. 6, the area in the vicinity of the bending point B is an area indicated by a fan shape (circular arc) CR which is a range equidistant from the bending point B. The area in the vicinity of the bending point B is not limited to a fan shape (circular arc) CR; but may be a diamond shape DA formed by the excavation target line TL1 and the excavation target line TL2 extending from the bending point B. Hereinafter, the area indicated by the symbol CR (DA) in FIG. 6 is also referred to as a "bending point warning area".

In the guidance process according to the present embodiment, when the angle formed by the plurality of excavation target surfaces is less than 180° C., as shown in FIG. 6, based on the bending point warning area formed in the vicinity of the bending portion, guidance Is executed. Furthermore, in some cases, only the inclined surface is the excavation target surface (excavation target line TL1), and the flat surface may not be excavated. Therefore, one of the surfaces forming the bent portion may be "a surface that is not to be excavated".

Specifically, when the bucket 6 is moved along the excavation target line TL1 (slope face excavation operation), and the toe of the bucket 6 enters the area indicated by the fan shape (circular arc) CR, the report sound is changed from the in-target report sound or the outside-target report sound, to the bending point report sound. Therefore, this time, the operator moves the bucket 6 along the excavation target line TL2 (horizontal pulling motion).

Note that after the toe of the bucket 6 passes the area indicated by the fan shape (circular arc) CR, the bending point report sound is no longer emitted and a regular voice sound guidance process is performed. That is, when the toe of the bucket 6 moves along the excavation target line TL2 after passing the area indicated by the fan shape (circular arc) CR, and the toe of the bucket 6 is within the predetermined distance from the excavation target line TL2, the in-target report sound is emitted to report this to the operator. Furthermore, when the distance from the excavation target line TL2 to the toe of the bucket 6 exceeds the predetermined distance when moving along the excavation target line TL2, the outside-target report sound is emitted to report this to the operator.

The extension lines EL1 and EL2 are set by the extension line setting unit 507. In the guidance process, the extension line setting unit 507 determines whether extension lines EL1 and EL2 extend into underground. If it is determined that the extension lines EL1 and EL2 extend into extend into underground, the extension line setting unit 507 sends information indicating this to the report control unit 505. Then, the report control unit 505 does not perform voice sound guidance for the extension lines EL1 and EL2 that have been determined to extend into underground.

According to the disclosed embodiment, guidance for appropriate operation can be performed also at a portion where the excavation target line is bent in the cross section.

Preferred embodiments and examples of the present invention including the excavator are described above; however, the present invention is not limited to the above-described embodiments and examples. Furthermore, variations and modifications may be made to the present invention in view of the scope of the claims attached hereto.

What is claimed is:

1. An excavator comprising a machine guidance device having a machine guidance function, wherein the machine guidance function performs voice sound guidance by emitting a report sound when a region of work by an end attachment approaches a predetermined distance to an excavation target surface, determines whether an angle formed by a plurality of excavation target surfaces is greater than or equal to 180 degrees in an area along an extension surface set in an extended direction from the excavation target surface, does not perform voice sound guidance along the extension surface when the angle formed by the plurality of excavation target surfaces is less than 180 degrees, and performs the voice sound guidance by emitting a report sound when the angle formed by the plurality of excavation target surfaces is greater than or equal to 180 degrees and the region of work by the end attachment approaches a predetermined distance to the extension surface.

2. The excavator according to claim 1, wherein the report sound relating to the excavation target surface is a different sound from the report sound relating to the extension surface.

3. The excavator according to claim 1, wherein another excavation target surface that is inclined is intersecting the excavation target surface, an extension surface is also set for the other excavation target surface, and the machine guidance function determines which one of the extension surfaces is to be a basis used to perform the voice sound guidance.

4. An excavator comprising a machine guidance device having a machine guidance function, wherein the machine guidance function performs voice sound guidance by emitting a report sound when a region of work by an end attachment approaches a predetermined distance to an excavation target surface, determines whether an angle formed by a plurality of excavation target surfaces is greater than or equal to 180 degrees, and performs machine guidance when the angle formed by the plurality of excavation target surfaces is less than 180 degrees and the region of work by the end attachment a vicinity of a bent portion of an excavation target surface, the machine guidance reporting that the region of work by the end attachment approaches the vicinity of the bent portion of the excavation target surface.

5. The excavator according to claim 4, wherein the excavator performs voice sound guidance to notify of the bent portion, when the region of work by the end attachment approaches the vicinity of the bent portion of the excavation target surface.

6. The excavator according to claim 4, wherein the excavator performs voice sound guidance to notify of an intersection portion, when a tip of the bucket approaches the intersection portion where the excavation target surface intersects another excavation target surface.

7. The excavator according to claim 6, wherein, the excavator notifies of the bent portion or the intersection portion, when the region of work by the end attachment enters a predetermined area formed at the bent portion or at the intersection portion.

* * * * *